US006161363A

United States Patent [19]

Herbst

[11] Patent Number: 6,161,363

[45] Date of Patent: Dec. 19, 2000

[54] MOLDED DOOR FRAME AND METHOD

[76] Inventor: Walter B. Herbst, 1875 N. Pond La. Lake Forest, Lake Forest, Ill. 60045

[21] Appl. No.: 09/477,460

[22] Filed: Jan. 4, 2000

Related U.S. Application Data

[63] Continuation of application No. 09/211,058, Dec. 14, 1998, abandoned, which is a continuation-in-part of application No. 08/864,628, May 28, 1997, abandoned, which is a continuation-in-part of application No. 08/480,693, Jun. 7, 1995, Pat. No. 5,634,508, which is a division of application No. 08/735,019, Oct. 22, 1996, abandoned.

[51] Int. Cl.[7] ..... E04C 2/00

[52] U.S. Cl. ..... 52/784.15; 52/784.16; 52/784.1; 52/783.1; 52/656.4; 52/792.11; 52/782.1; 52/796.1; 49/501; 49/502; 49/503; 160/371; 160/380

[58] Field of Search ..... 52/309.9, 784.12, 52/784.13, 784.15, 783.1, 784.1, 784.16, 656.4, 792.11, 796.1; 264/46.5; 49/501, 502, 503; 160/369, 371, 380

[56] References Cited

U.S. PATENT DOCUMENTS

| | | | |
|---|---|---|---|
| 4,327,535 | 5/1982 | Governale | 52/309.11 |
| 4,965,030 | 10/1990 | Thorn | 264/46.5 |
| 5,161,346 | 11/1992 | Olson et al. | 52/746.1 |
| 5,634,508 | 6/1997 | Herbst | 160/371 |
| 5,644,870 | 7/1997 | Chen | 49/501 |
| 5,720,142 | 2/1998 | Morrison | 52/309.9 |
| 5,744,077 | 4/1998 | Grisch et al. | 264/46.6 |
| 5,894,706 | 4/1999 | Herbst | 52/782.1 |

*Primary Examiner*—Christopher T. Kent
*Assistant Examiner*—Jennifer I. Thissell
*Attorney, Agent, or Firm*—Jack E. Dominik

[57] ABSTRACT

Disclosed is the utilization of two halves for a door with tops, bottoms, and sides defining circumambient outside portions and a window portion having tops, bottoms, and sides forming a window circumambient portion, in which the circumambient portion of the outside and the circumambient portion of the window opening constitute dams which will preclude the flow of a foaming material. When the two door halves are secured together, the interior voids are filled with an expanding foam such as a two part urethane. The foam can be inserted through ports in the bottom and/or the top. In the final form, the frame two halves are secured together adhesively by the foam which adheres to the entire inner skin of both halves. The foam also provides insulation. Additionally, the foam reinforced by the skins imparts substantial structural strength to the door.

7 Claims, 5 Drawing Sheets

MOLDED DOOR FRAME AND METHOD

RELATED APPLICATIONS

This Application is a Continuation of application Ser. No. 09/211,058, filed Dec. 14, 1998, now abandoned, which is a Continuation of Continuation-In-Part of Ser. No. 08/864,628, filed May 28, 1997, now abandoned, which is a Continuation-In-Part of Ser. No. 08/480,693, filed Jun. 7, 1995, now U.S. Pat. No. 5,634,508, which is a Divisional of application Ser. No. 08/735,019, filed Oct. 22, 1996, now abandoned.

FIELD OF THE INVENTION

The present invention relates to doors, and primarily storm doors although in a closed front configuration, the same can be used for a primary door or an interior door.

BACKGROUND OF THE INVENTION

Doors of the molded storm door type are exemplified by Applicant's U.S. Pat. No. 4,311,183. In particularly Applicant's U.S. Pat. No. 4,311,183 relating to a storm door which self stores the screen and the window portion, and is formed of two molded halves is the principal prior art. It has enjoyed significant commercial success. However, for a lower priced door having dimensional stability, and the ability for presenting an opening which can house a screen, or a window, either removably or semi-permanently, some of the elements of the prior art door are not required. A lower effective cost can be achieved when the door is formed of two halves, and secured without screws or other devices or auxiliary equipment.

SUMMARY OF THE INVENTION

The present invention is based upon the utilization of two halves for a door in which the circumambient portion of the outside and the circumambient portion of the window opening constitute dams which will preclude the flow of a foaming material. When the two door halves are secured together, the interior voids are filled with an expanding foam such as a two part urethane. The foam can be inserted through ports in the bottom and/or the top. In the final form, the frame two halves are secured together adhesively by the foam which adheres to the entire inner skin of both halves. The foam also provides insulation. Additionally, the foam reinforced by the skins imparts substantial structural strength to the door.

In view of the foregoing, it is a principal object of the present invention to provide a highly cost effective, yet durable, door frame from two halves which are positioned opposite each other, and define an in-lace mold for a foam which is inserted interiorly to fill the voids and adhere the two halves together.

A further object of the present invention is to provide a door frame which is dimensionally stable, and adaptable to a wide variety of finished configurations attributable to the fact that the opening in the door will accommodate a wide variety of window, screen, and other auxiliary mountings.

Yet another object of the invention is to provide a door with the foregoing advantages which has the security aspect of not readily permitting one half to be removed from the other without destroying the entire door, thereby along with a secure latching mechanism and hinge mechanism, provides insecurity to the door itself.

DESCRIPTION OF THE ILLUSTRATIVE DRAWINGS

Further objects and advantages of the present invention will become apparent as the following description of an illustrative embodiment proceeds, taken in conjunction with the accompanying drawings, in which.

DESCRIPTION OF PREFERRED EMBODIMENTS

Figure 1:
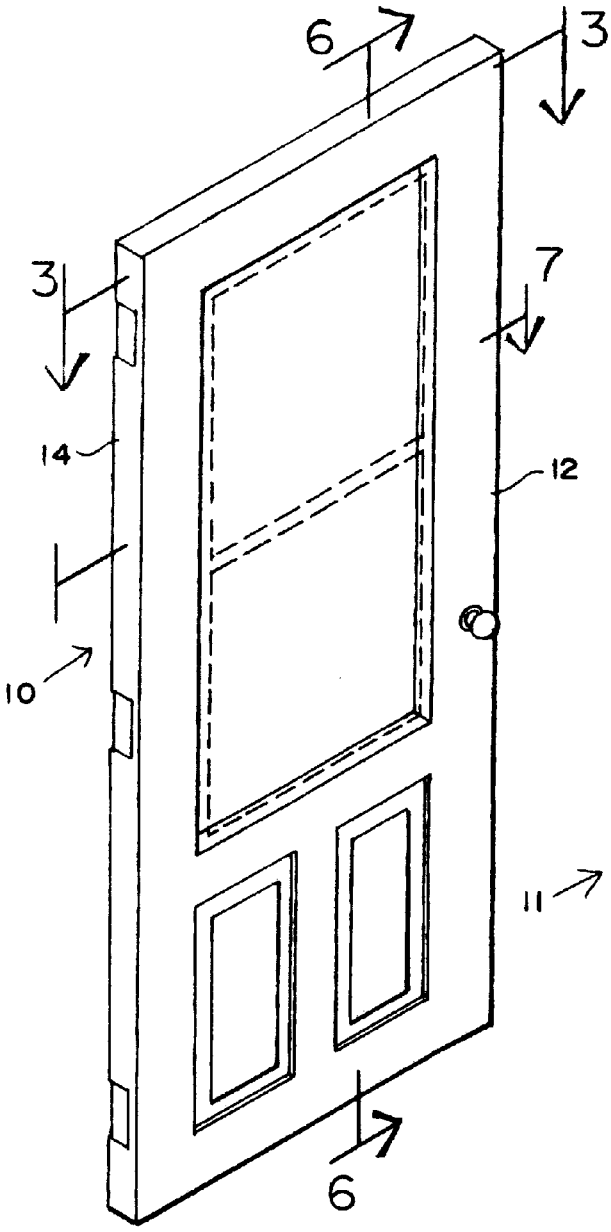
FIG. 1 is a perspective view of a door having a window/screen opening illustrative of the present invention.
Figure 2:
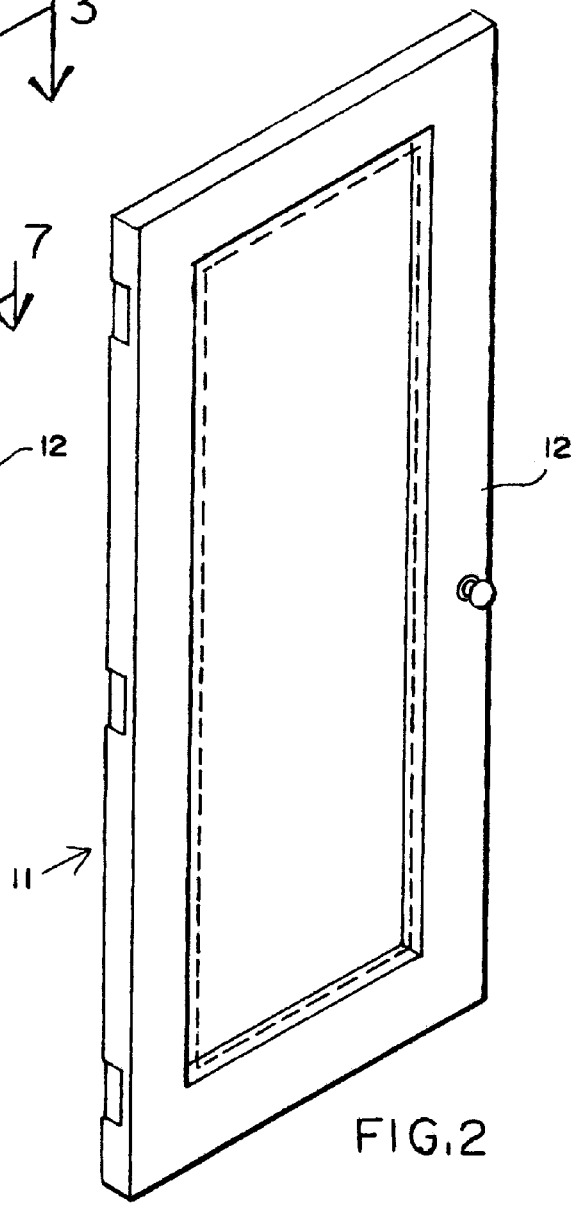
FIG. 2 is an alternative embodiment of the subject door with a full view opening.
Figure 3:
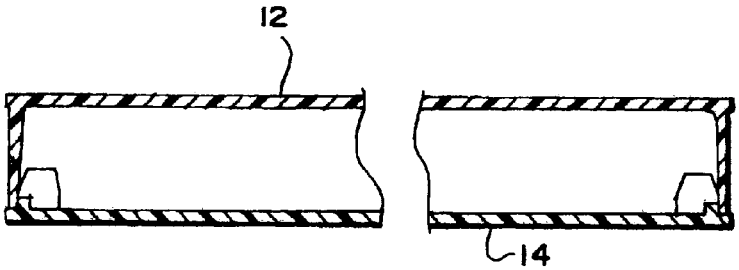
FIG. 3 is a partially broken transverse sectional view of the door taken along section line 3—3 of FIG. 1.
Figure 11:
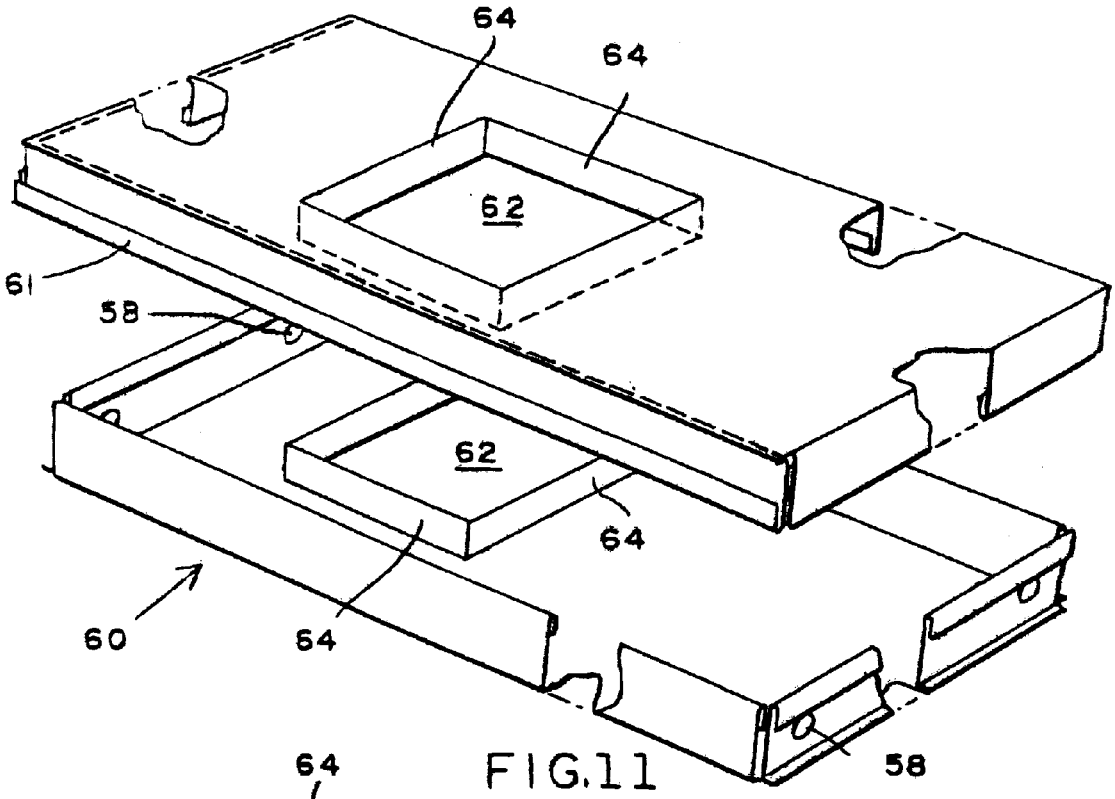
FIG. 11 is a perspective exploded view of an alternative embodiment door made of formed sheet metal.
Figure 12:
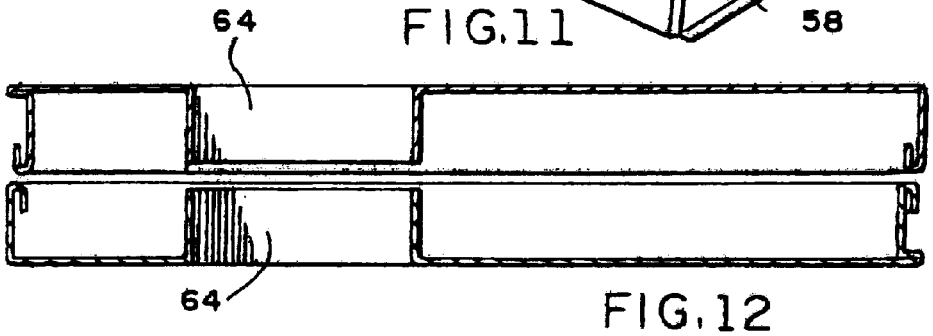
FIG. 12 is a longitudinal sectional view of the two halves of the door shown in FIG. 11 as they approach each other for securement.
Figure 13:
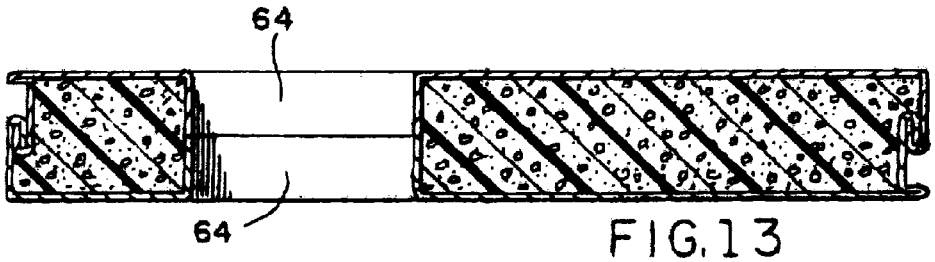
FIG. 13 is yet another sequence to FIG. 12 showing the two halves joined together and interlocking at their ends.
Figure 14:
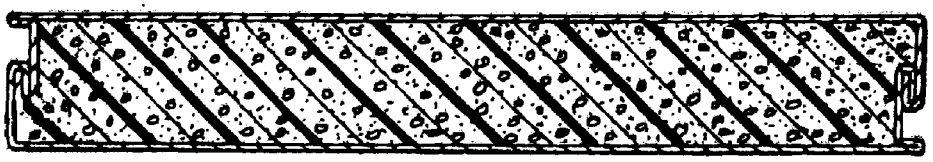
FIG. 14 is a further embodiment of the door shown in FIGS. 11, 12, and 13 with flush edges at both ends.

The preferred embodiments of the present invention are illustrated in all of the drawings. As will be seen in FIG. 1, the door frame 10, having a front 11 is made up of an outer front frame 12 and an inner frame 14, as will be described hereinafter. FIG. 11 discloses a door frame as well, but of the full view variety. As will be seen in FIG. 3, a cross-section of the window opening of the door shown in FIG. 1, the frame 10 is surrounded by a peripheral dam 15.

Figures 4, 5:
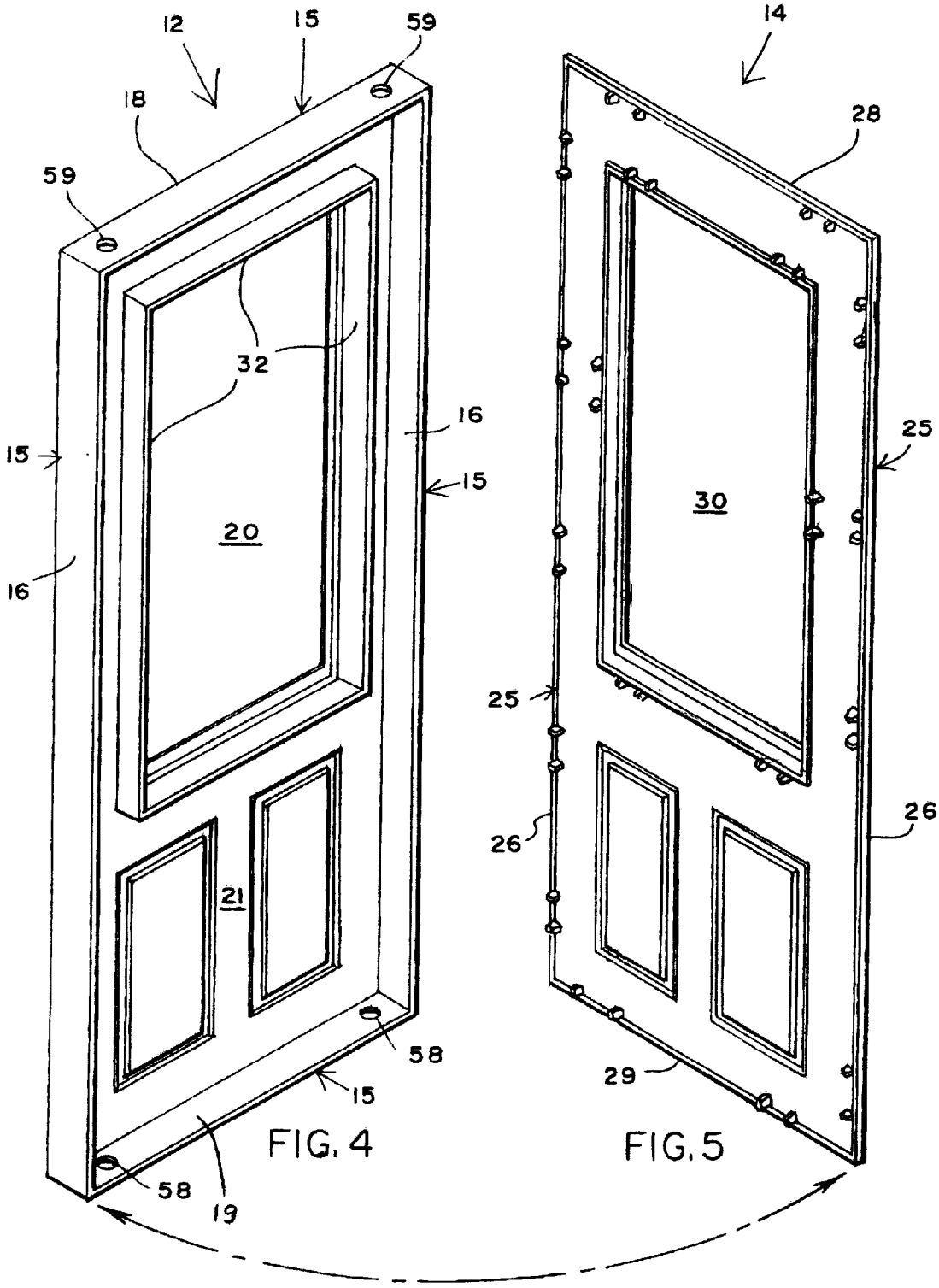
FIG. 4 is a perspective view of the outer half of the subject door.
FIG. 5 is a perspective view of the inner half of the subject door.
Figure 6:
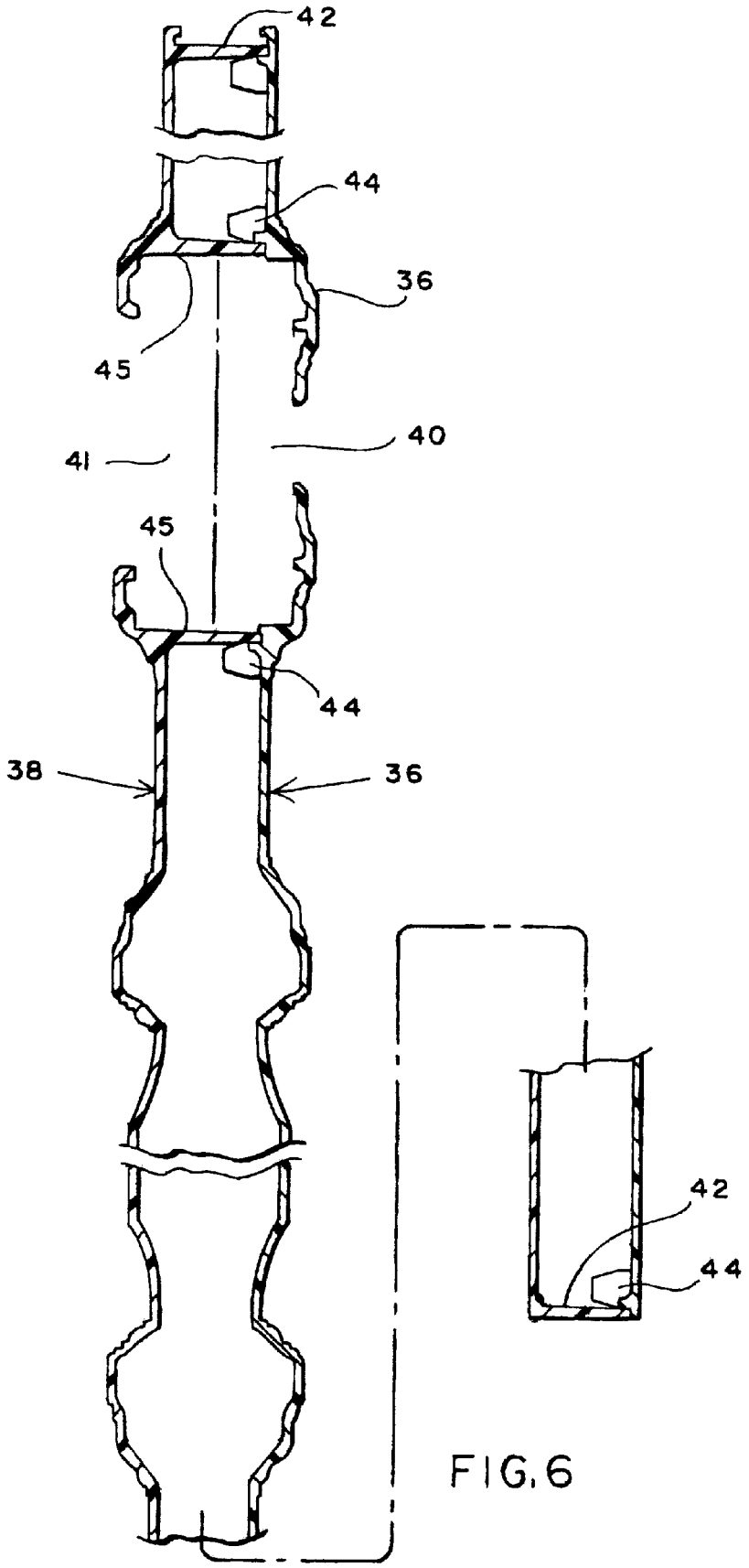
FIG. 6 is a vertical transverse sectional view of the door taken along section line 6—6.

Turning now to FIG. 6, it will be seen that the dam assembly which is at the periphery 15 includes side dam walls 16, a top dam wall 18, and a bottom dam wall 19. This is on the outer panel 12. On the inner panel 14, as shown in FIG. 5, peripheral dam joint 25 circumambiates the inside panel 14, and includes side dam joint 26, top dam joint 28, and bottom dam joint 29. The window 20, with a kick panel 21 below it (see FIG. 4), is provided in the opening on the outside panel 12, and a comparable window opening 30 is provided on the inner panel 14. The window openings 20, 30 have circumambient dam wall portions 32, formed and proportioned to matingly engage the opposite dam wall portions in the outer panel 12.

Further elements of the door frame will become apparent in FIG. 6. There it will be seen that in the alternative door shown 35, there is an outer 36 and an inner 38 panel. Window 40 opening is in the outer panel 36, and the window opening 41 is in the inner panel 38. A dam wall joint 44 is provided at positions opposed to the dam walls 45 and dam walls 42.

Figure 7:
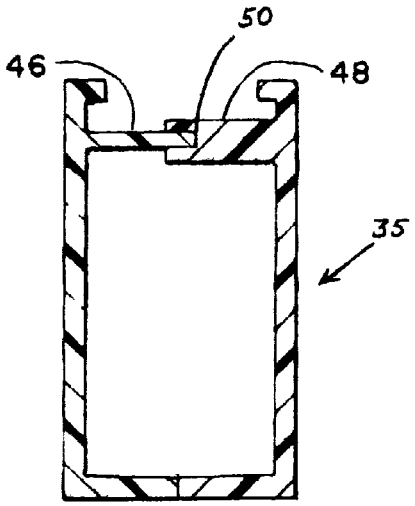
FIG. 7 is an alternative embodiment of the dam construction taken along section line 7—7 of FIG. 2.
Figure 9:
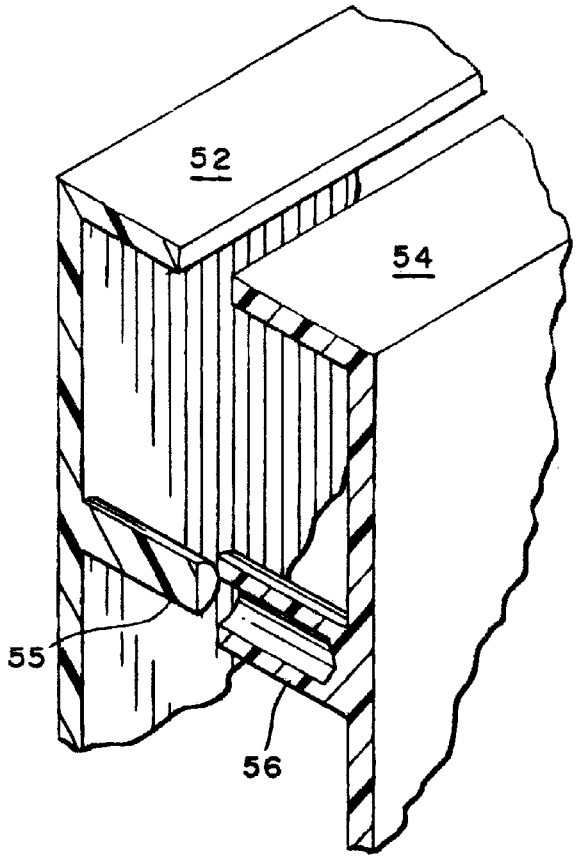
FIG. 9 is yet another alternative embodiment of the dam wall construction but also showing how opposite pins may be employed for the further securement of one-half of the door to the other.
Figure 8:
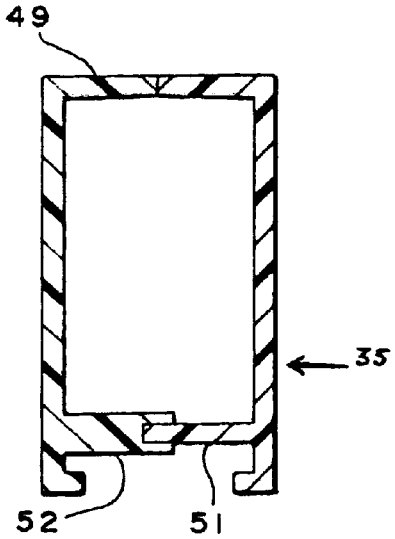
FIG. 8 is an alternative embodiment of the structure shown in FIG. 7 also taken generally along section line 7—7 of FIG. 1.

Further alternative dam wall sections are shown in FIGS. 7, 8, and 9. Specifically in FIG. 7, the alternative dam wall joint 48 discloses a wall portion 46 which in turn fits into a recess in an upstanding boss 50. The opposite ends are butt jointed. In FIG. 8 the alternative butt joint 49 is at the exterior, and the interior portion includes a dam wall 51 engaging a boss 52, the opposite as shown in FIG. 7.

Yet another opposed structure is shown in FIG. 9 where the two dam walls 52 and 54 are proportioned to overlap each other, but are also reinforced by pin 55 which extends from one panel to insert into the mounting boss 56 having a cylindrical interior hollow portion for matingly engaging pin 55.

Figure 10:
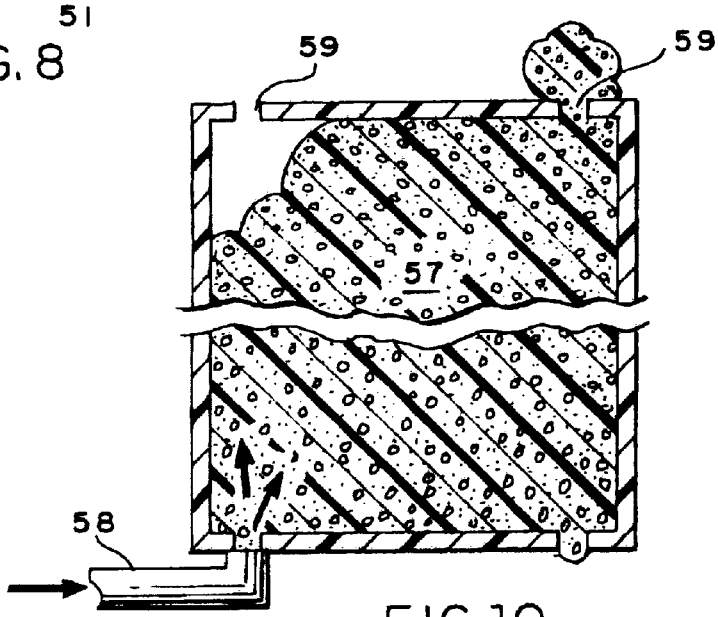
FIG. 10 is a diagrammatic sectional view of the door showing the foam being inserted to secure the two halves of the door.

Turning now to FIG. 10, there is diagrammatically shown the foaming procedure which is generic to all of the alternative doors shown. There it will be seen that a nozzle port 58 is provided at the lower portion of the door, and receives nozzle 58 which foams in the interior walled off portions of the door. A relief portion 59 is provided at the upper port for air and/or foam relief.

Yet another embodiment of the door is shown in FIGS. 11–14. In FIG. 11 it will be seen that the outer panels and inner panels are formed from a sheet material thereby forming a sheet frame 60. Formed walls 61 circumambient the periphery of the door frame, and comparable dam walls 64 circumambiate the window opening as one may appear, thus window openings 62 are surrounded by dam wall portions 64.

In accordance with the method of the present invention, essentially generic to all of the aforesaid alternative embodiments, panels are first formed, inner and outer, to be matingly engaged each to the other. Essential to the formation of the panel is a circumambient exterior dam wall assembly, and a circumambient window opening dam wall assembly. Once the two panels are secured to each other, the dam wall portions overlap to define an interior void. Thereafter, the void is filled by penetrating the interior portion of the door through one of its edges, preferably the bottom and/or the top, and inserting a predetermined amount of foam to fill the entire void. Once the void is filled, the two halves are adhesively secured to each other by the foam, a strong structural form is imparted to the door since the opposed frame skin portions are spaced from each other structurally, and in addition once the foam has cured, it adhesively secures the two halves to each other.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A door frame having an inner panel and outer panel, each panel having a central essentially rectangular opening for a window, said door frame having side edges, a top edge, and bottom edge, said central opening having side edges, a top edge, and a bottom edge, all of said edges being integrally formed in said panels from which said edges extend from the panel, comprising:

said outer edges forming a dam wall assembly surrounding the exterior periphery of the door and the central opening edges forming, with the outer edges, an essentially continuous pre-filling unblocked hollow inside of the door panels, all of said edges being formed as a unitary one piece molded circumambient extension from the panels, each of said edges engaging the opposed edge in foam blocking relationship, the edges of the door also serving as the dam wall assembly in the absence of secondary stiles, rails, or other independent elements inserted interiorly of the essentially continuous rectilinear dammed uninterrupted and unblocked hollow space interiorly of the door, a continuous pre-filling void for foam filling being defined by the circumambient side edges, top edge, and bottom edge for uninterrupted foam filling, and a foamed in place interior essentially filling the hollow space defined by the edges, whereby the finished door has a uniform and unitary uninterrupted foamed in place core to fill the hollow space, add to structural integrity, enhance the monocoque effect of the overall door structure, and adhere the inner and outer skin to each other without the use of secondary mechanical assembly steps in the formation and filling of the interior hollow space by blocking the escape of foam at the joints between the edges and permitting the foam access to the entire hollow space from any exterior location.

2. In the door according to claim 1, outer and inner extensions into the window area to define overlapping opposed framing borders for receiving the window.

3. In the door according to claim 1, said dam wall edge and window portion extensions from both the outer skin and the inner skin to overlappingly engage the opposed wall portions.

4. A door having an outer panel and an inner panel, each panel having a central opening for a window, said panels defining a door frame having side edges, a top edge, and bottom edge, said central opening having side edges, a top edge, and a bottom edge, comprising:

said edges surrounding the outer extremes of the door and the inner boundary of the central opening thereby forming a circumambient dam wall assembly, all of said dam walls assembly being formed by edge portions extending circumambient from each panel and integrally molded in said panels, each of said extending edge portion engaging an opposed overlapping foam blocking means forming an uninterrupted hollow interior between the opposed panels, the dam wall assembly and hollow interior characterized by the absence of secondary stiles, rails, or other independent elements inserted interiorly of the hollow interior, an uninterrupted pre-filling hollow interior surrounding the window edges and interior of the outer edges, and a foam filled uninterrupted interior essentially filling the pre-filling hollow interior from any opening in the otherwise dammed hollow area defined by the edges and adhesively securing the inner and outer panels to each other, whereby the finished door has a foam filled core to fill the hollow interior, add to structural integrity, enhance the monocoque effect of the overall door structure, and adhere the inner and outer panels to each other.

5. A molded door frame having two frame panels, an outer panel and an inner panel, which panels are secured to each other by a foamed in place filling between the outer panel and the inner panel, the improvement comprising, side wall edges, a top wall edge, and a bottom wall edge on the inner door panel and the outer door panel defining circumambient outer edges;

each of said edges overlappingly engaging the opposite edge;

a window opening surrounded by circumambient side edges, top, and bottom edges defining inner edges and an open window area;

said inner edges overlapping each other and defining an essentially uninterrupted hollow space between the inner and outer edge;

all of said edges being formed integrally in said panels and extending from the panels; and a continuous hollow void between the panels which is unblocked and open so that foam may flow freely in any direction in said hollow void, whereby a continuous foam fill can occupy the hollow void and move into the entire hollow area without blockage and is surrounded by edges to adhesively secure the two frames together and to add strength to the structure and insulate the door.

6. A door having an outer panel and an inner panel, comprising, circumambient side edges, a top edge and a bottom edge integral with each of said panels formed for interlockingly engaging the opposite side, top and bottom edges of said outer and inner panels;

further edges forming a window opening having interlocking engagement means for engaging the opposite panel;

all of said edges forming an uninterrupted pre-filling unblocked hollow interior between the panels, and a foam filled interior passing continuously without interruption through the pre-filling hollow interior between the panels in the absence of secondary independently formed securing means for securing the outer frame to the inner frame;

whereby a door is formed with a foam filled interior, the foam for which is uninterrupted in its penetration of the entire hollow interior, and foam leakage is prevented by the interlocking engagement of the edges which prevent the seepage of blow-by experienced with a butt joint when foam is filled under pressure.

7. A method for forming a door having an outer panel, and an inner panel, said outer panel and inner panel each having outer side, top, and bottom edges, and an interior window opening having interior side, top, and bottom edges in each of said panels, said edges interlockingly engaging with the opposed edges, proportioning the edges to entirely and uninterruptedly circumambiate the exterior portion of the door and similarly to surround the interior window opening without interruptions in the hollow space so that foam can propagate throughout the entire hollow space without being blocked at any portion of the hollow space and seeping out a gap at the joint between the panels;

forming a hollow interior in the door which is continuous and unblocked to thereby permit the uninterrupted and unblocked filling with foam, the further step of securing said panels to each other by filling the hollow space between the panels and inner and outer edges with a foam in the absence of secondary independently formed and inserted securement means.

* * * * *